US012121124B2

(12) United States Patent
Lin et al.

(10) Patent No.: US 12,121,124 B2
(45) Date of Patent: Oct. 22, 2024

(54) LUGGAGE CASE CAPABLE OF BEING OPENED FORWARDS

(71) Applicant: XIAMEN SKYWALKER TECHNOLOGY COMPANY LIMITED, Fujian (CN)

(72) Inventors: Dequan Lin, Fujian (CN); Yanmei Liang, Fujian (CN)

( * ) Notice: Subject to any disclaimer, the term of this patent is extended or adjusted under 35 U.S.C. 154(b) by 133 days.

(21) Appl. No.: 17/798,903

(22) PCT Filed: Mar. 24, 2021

(86) PCT No.: PCT/CN2021/082508
§ 371 (c)(1),
(2) Date: Aug. 11, 2022

(87) PCT Pub. No.: WO2021/213121
PCT Pub. Date: Oct. 28, 2021

(65) Prior Publication Data

US 2023/0104899 A1 Apr. 6, 2023

(30) Foreign Application Priority Data

Apr. 23, 2020 (CN) ..... 202020623220.0

(51) Int. Cl.
*A45C 13/00* (2006.01)
*A45C 5/03* (2006.01)
*A45C 13/04* (2006.01)

(52) U.S. Cl.
CPC ..... *A45C 13/007* (2013.01); *A45C 5/03* (2013.01); *A45C 13/04* (2013.01)

(58) Field of Classification Search
CPC ..... A45C 13/007; A45C 5/03; A45C 13/04
See application file for complete search history.

(56) References Cited

U.S. PATENT DOCUMENTS

| | | | | |
|---|---|---|---|---|
| 137,951 | A * | 4/1873 | Palmer | E05F 1/1215 16/300 |
| 1,484,372 | A * | 2/1924 | Edwards | E05F 1/1215 16/256 |
| 9,486,046 | B2 * | 11/2016 | Krulik | A45C 5/03 |
| 2004/0163913 | A1 * | 8/2004 | Tschudy | A45C 15/00 190/110 |
| 2019/0313752 | A1 * | 10/2019 | Luo | A45C 13/04 |

* cited by examiner

*Primary Examiner* — Tri M Mai

(57) ABSTRACT

A luggage case capable of being opened forwards, including a case body; a front panel is provided on the case body; a panel fixing frame is on a side of the front panel facing an inner cavity of the case body; a snap-fitting structure is provided between the front panel and the panel fixing frame; a bottom part of the panel fixing frame is provided with a panel-opening structure, which includes a hinge assembly; bearings and springs are provided in the hinge assembly; two ends of the hinge assembly are fixed to the panel fixing frame and the case body respectively; an opening-closing structure is provided between a top part of the front panel and the case body; when the opening-closing structure is opened, the bearings drive the hinge assembly to rotate forwards to push open the front panel under resilient force of the springs.

9 Claims, 3 Drawing Sheets

LUGGAGE CASE CAPABLE OF BEING OPENED FORWARDS

BACKGROUND OF THE INVENTION

The present utility model relates to the field of luggage cases, and more particularly a luggage case capable of being opened forwards.

A luggage case is one of the tools for people to store their daily items while traveling, which is mainly adopted to store daily items. A conventional luggage case is generally provided with only one zipper for opening and closing, thus requiring users to unzip the zipper when taking out items from the luggage case, which is lacking fresh experience. Currently, there are luggage cases on the market with an opening on a front side of a case body, but most of them are provided with a simple structure and being incapable to be opened forward.

Based on the above mentioned, the present application is produced after conducting in-depth studies on the above problems.

BRIEF SUMMARY OF THE INVENTION

It is an object of the present utility model to solve the above problems of the prior art by providing a luggage case capable of being opened forwards, with an improved structure of a front opening panel and a case body. The luggage case of the present utility model can be opened forwards for users to take out items from the luggage case, thereby greatly improving users' experience.

A luggage case capable of being opened forwards, comprising a case body and a pull handle configured on the case body; a front panel is provided on the case body; a panel fixing frame is provided on a side of the front panel facing towards an inner cavity of the case body; a snap-fitting structure is provided between the front panel and the panel fixing frame; a panel-opening structure is provided at a bottom part of the panel fixing frame; the panel-opening structure comprises a hinge assembly; a pair of bearings and a pair of springs are provided in the hinge assembly; one end of the hinge assembly is fixed on the panel fixing frame, and another end of the hinge assembly is fixed on the case body; an opening-closing structure is provided between a top part of the front panel and the case body; when the opening-closing structure is opened, the front panel is opened by rotation of the hinge assembly driven by the bearings under action force of the springs.

Furthermore, the hinge assembly comprises an upper hinge and a lower hinge; the upper hinge is fixedly connected to the panel fixing frame; the lower hinge is fixedly connected to the case body.

Furthermore, the upper hinge is provided with a pair of bearing holes; each bearing passes through a corresponding bearing hole; the lower hinge is provided with fixing grooves; when the bearings pass through the bearing holes, two ends of each bearing exposed from the corresponding bearing hole are mounted to a corresponding fixing groove, so as to connect the upper hinge and the lower hinge.

Furthermore, each spring winds around a corresponding bearing; the front panel is pushed open by resilient force of the springs when the front panel is allowed to open by opening the opening-closing structure.

Furthermore, the snap-fitting structure comprises a plurality of male buckles and female buckles; the male buckles are provided on the panel fixing frame; the female buckles are provided on the front panel; when the front panel and the panel fixing frame are connected, the male buckles are snap fitted with the female buckles.

Furthermore, the opening-closing structure is a lock hook structure; a mounting base is provided at a bottom part of the lock hook structure; the mounting base is fixedly provided on the front panel.

Furthermore, the lock hook structure comprises a hook hole and a hook; the hook hole is provided on an inner side wall of the case body; the hook is provided on the mounting base.

Furthermore, an accommodating groove is provided on a side of the case body; a pull handle is provided inside the accommodating groove.

In comparison to the prior art, the beneficial effects of the present invention are as follows:

First, the snap-fitting structure of the present utility model is an inventive design configured to connected the front panel and the panel fixing frame; instead of adopting a front panel of a conventional case provided with leather strips on the edges of the front panel for fixation, the present utility model adopts injection molded parts fixed by snap-fitting, thus improving the tidiness and appearance of the front panel and the panel fixing frame, and being more stable and convenient after being fixed;

Second, the case body and the front panel of the present utility model are connected through the panel-opening structure configured in between; the panel-opening structure comprises a hinge assembly; the hinge assembly is provided with a pair of bearings and a pair of springs; the bearings are configured to connect the upper hinge and the lower hinge; when pressing the opening-closing structure, the front panel is opened; specifically, the bearings drive the hinge assembly to rotate forwards, so as to open the front panel under the resilient force of the springs. The entire process is fast and convenient, and greatly improves users' experience when using the luggage case.

Figure 1:
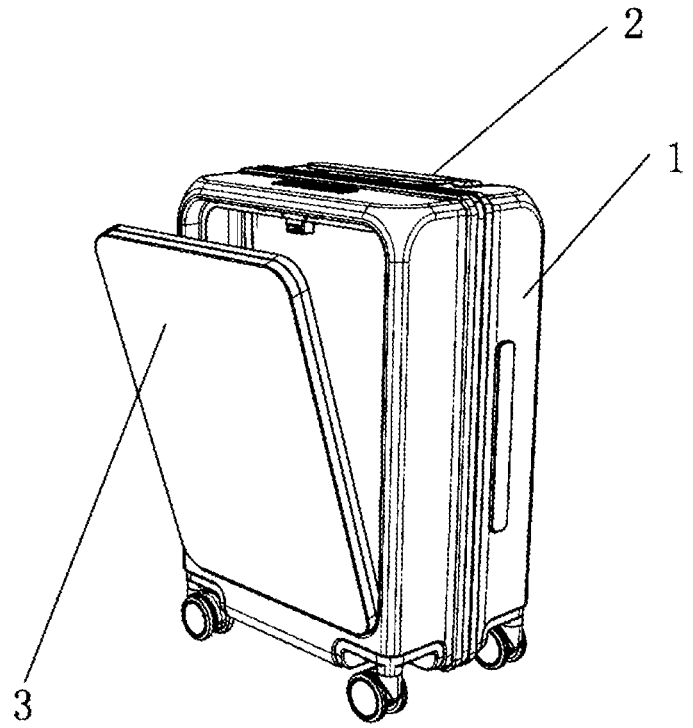
FIG. 1 shows a perspective view of the front panel of the present utility model in an opened status.
Figure 2:
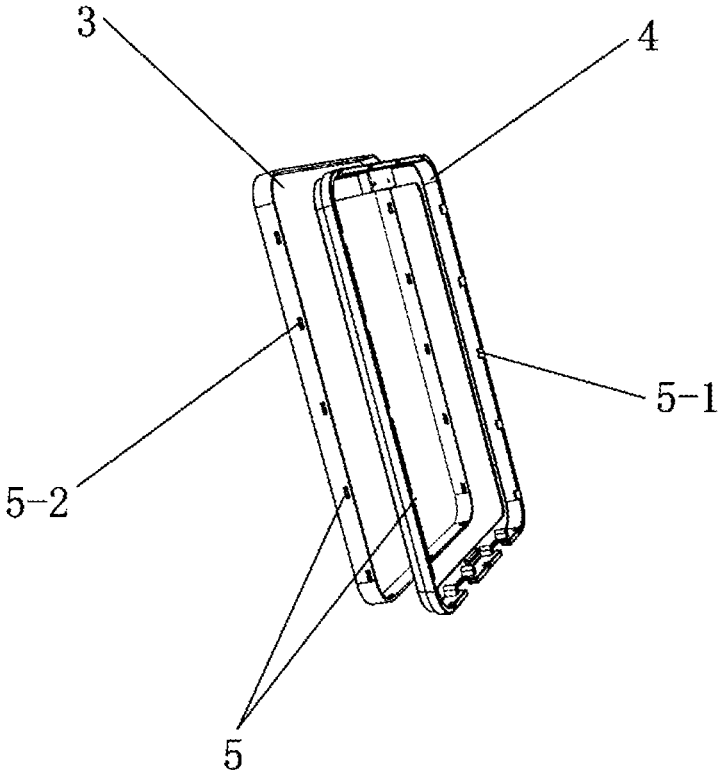
FIG. 2 is a perspective view showing how the front panel and the panel fixing frame of the present utility model are connected.
Figure 3:
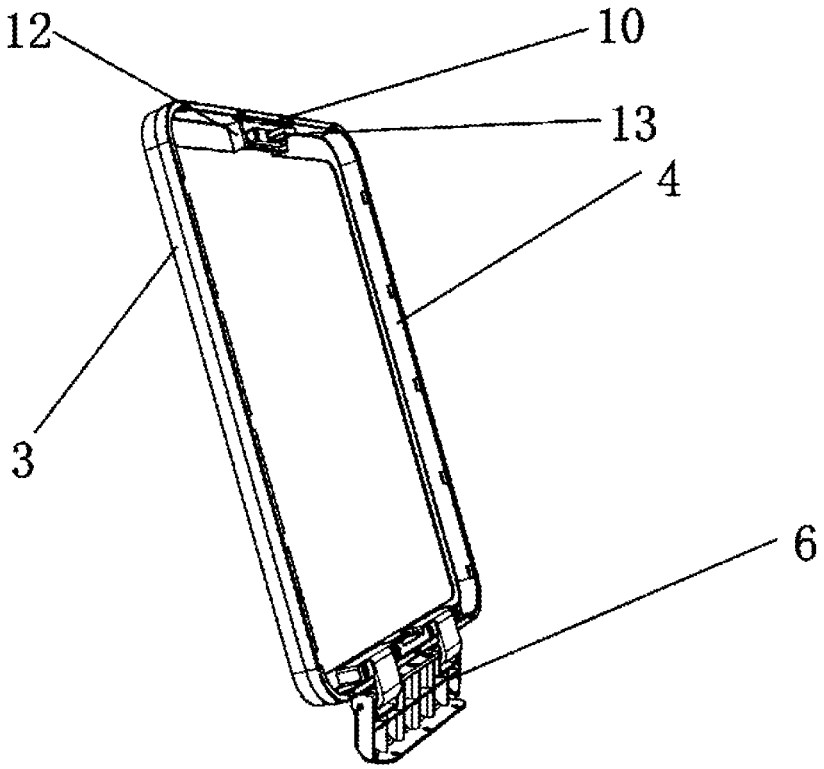
FIG. 3 shows a perspective view of the panel-opening structure and the front panel of the present utility model in a connected status.

1 denotes the case body; 2 denotes the pull handle; 3 denotes the front panel; 4 denotes the panel fixing frame; 5 denotes the snap-fitting structure; 5-1 denotes the male buckles; 5-2 denotes the female buckles; 6 denotes the panel-opening structure; 7 denotes the hinge assembly; 7-1 denotes the upper hinge; 7-2 denotes the lower hinge; 8 denotes the springs; 9 denotes the bearings; 10 denotes the opening-closing structure; 11 denotes the fixing grooves; 12 denotes the mounting base; 13 denotes the hook.

DETAILED DESCRIPTION OF THE INVENTION

The following will describe in detail the present utility model with reference to the accompanying drawings and embodiments. It is noted that the technical features in the embodiments of the present utility model can be combined with each other so long as no conflict is caused.

As illustrated in FIGS. 1-5, to improve users' experience, the present utility model provides a new type of luggage case, namely a luggage case capable of being opened forwards, comprising a case body 1 and a pull handle 2 configured on the case body 1; an aluminum luggage case is preferred in order to enhance the compression resistance and carrying capacity of the luggage case; it is noted that the material adopted for the luggage case should not limit the protection scope of the present utility model.

An opening in communication with an inner cavity of the case body 1 is provided on a front side of the case body 1; a front panel 3 is provided on the opening to close and open the opening; a panel fixing frame 4 is provided on a side of the front panel 3 facing towards the inner cavity of the case body 1; preferably, the panel fixing frame 4 is made of high-strength materials, such as aluminum; a snap-fitting structure 5 is provided between the front panel 3 and the panel fixing frame 4; the snap-fitting structure 5 comprises a plurality of male buckles 5-1 and female buckles 5-2; the male buckles 5-1 are provided on the panel fixing frame 4; the female buckles 5-2 are provided on the front panel 3; when the front panel 3 and the panel fixing frame 4 are connected, the male buckles 5-1 are snap fitted with the female buckles 5-2; the snap-fitting structure 5 of the present utility model is an inventive design configured to connected the front panel 3 and the panel fixing frame 4; in a conventional luggage case that has an openable front panel, the front panel is fixed by leather strips provided on the edges of the panel. By contrast, the present utility model adopts injection molded parts fixed by snap-fitting, thus improving the tidiness and appearance of the front panel 3 and the panel fixing frame 4, and being more stable and convenient after being fixed.

Figure 4:
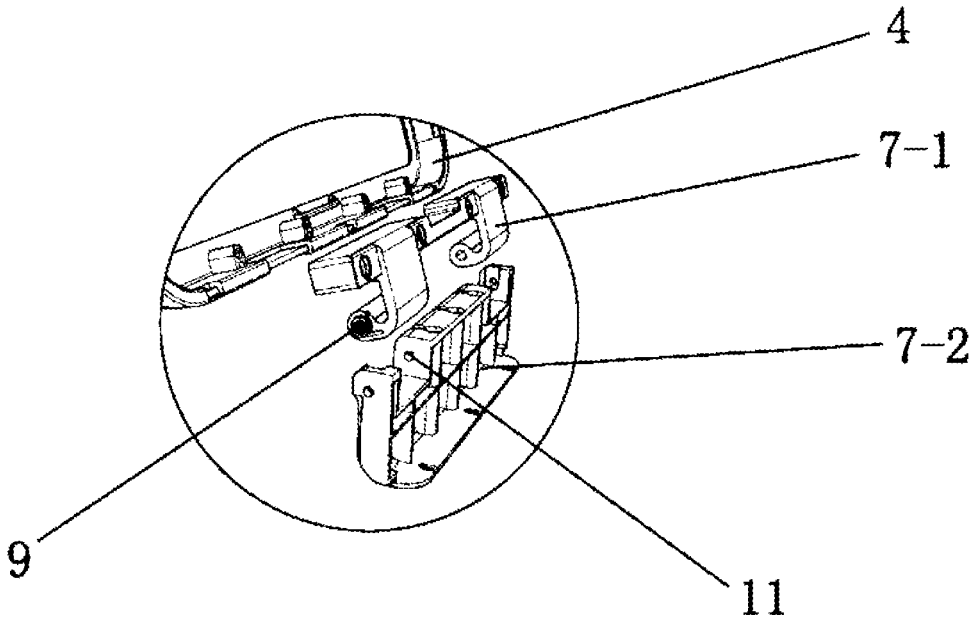
FIG. 4 shows an exploded perspective view of the panel-opening structure of the present utility model.
Figure 5:
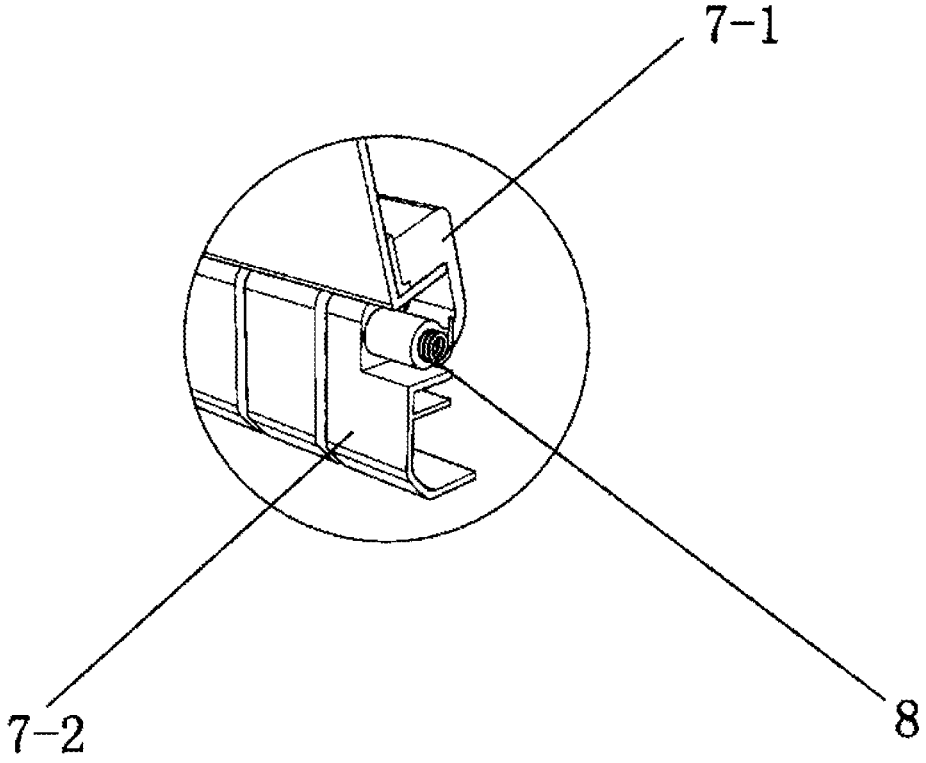
FIG. 5 shows a partially enlarged view of the panel-opening structure of the present utility model.

Preferably, a panel-opening structure 6 is provided at a bottom part of the panel fixing frame 4; the panel-opening structure 6 comprises a hinge assembly 7; a pair of bearings 9 and a pair of springs 8 are provided in the hinge assembly 7; one end of the hinge assembly 7 is fixed on the panel fixing frame 4, and another end of the hinge assembly 7 is fixed on the case body 1; as illustrated in FIGS. 4-5, the hinge assembly 7 comprises an upper hinge 7-1 and a lower hinge 7-2; the upper hinge 7-1 is fixedly connected to the panel fixing frame 4; the lower hinge 7-2 is fixedly connected to the case body 1; the upper hinge 7-1 is provided with a pair of bearing holes (not shown in the drawings); each bearing 9 passes through a corresponding bearing hole; the lower hinge 7-2 is provided with fixing grooves 11; when the bearings 9 pass through the bearing holes, two ends of each bearing 9 exposed from the corresponding bearing hole are mounted to a corresponding fixing groove 11, so as to connect the upper hinge 7-1 and the lower hinge 7-2.

Preferably, each spring 8 winds around a corresponding bearing 9; an opening-closing structure 10 is provided between a top part of the front panel 3 and the case body 1; the opening-closing structure 10 is a lock hook structure; a mounting base 12 is provided at a bottom part of the lock hook structure; the mounting base 12 is fixed on the front panel 3; when the opening-closing structure 10 is opened, the front panel 3 is opened; specifically, when the opening-closing structure 10 is opened, the front panel 3 is opened by rotation of the hinge assembly 7 driven by the bearings 9 under action force of the springs 8.

It should be noted that, the opening-closing structure 10 of the present utility model functions similarly to the opening and closing function of a front panel of a conventional luggage case.

Preferably, the lock hook structure 10 comprises a hook hole (not shown in the drawings) and a hook 13; the hook hole is provided on an inner side wall of the case body 1; the hook 13 is provided on the mounting base 12.

Preferably, an accommodating groove (not shown in the drawings) is provided on a side of the case body 1; a pull handle 2 is provided inside the accommodating groove.

To better explain the technical solutions of the present utility model, the following will describe in detail the mechanism and operating process of the present utility model with reference to FIGS. 1-5:

To solve the existing problems of conventional luggage cases, including the complicated process of opening a front panel, or the lack of front opening function, the luggage case of the present utility model not only provides conventional case body and pull handle, but further provides a front panel 3 on a surface of the case body 1; a panel fixing frame 4 is provided on a side of the front panel 3 facing towards the case body 1; a snap-fitting structure 5 is provided between the front panel 3 and the panel fixing frame 4; the snap-fitting structure 5 comprises a plurality of male buckles 5-1 and female buckles 5-2; the male buckles 5-1 are provided on the panel fixing frame 4; the female buckles 5-2 are provided on the front panel 3; instead of adopting a front panel of a conventional luggage case provided with leather strips on the edges of the front panel for fixation, the present utility model adopts injection molded parts fixed by snap-fitting, thus improving the tidiness and appearance of the front panel 3 and the panel fixing frame 4, and being more stable and convenient after being fixed; the panel fixing frame 4 and the case body 1 are connected to each other through a panel-opening structure 6 configured in between; an opening-closing structure 10 is provided between a top part of the front panel 3 and the case body 1; preferably, the opening-closing structure 10 adopts a lock hook structure; the lock hook structure is configured to control the front panel 3 to partially disengage from the case body 1; the panel-opening structure 6 provided at a bottom part of the front panel 3 comprises a hinge assembly 7; the hinge assembly 7 comprises an upper hinge 7-1 and a lower hinge 7-2; the upper hinge 7-1 is fixedly connected to the panel fixing frame 4; the lower hinge 7-2 is fixedly connected to the case body 1; the upper hinge 7-1 are provided with a pair of bearing holes; each bearing 9 passes through a corresponding bearing hole; the lower hinge 7-2 is provided with fixing grooves 11; when the bearings 9 pass through the bearing holes, two ends of each bearing 9 exposed from the corresponding bearing hole are mounted to a corresponding fixing groove 11, so as to connect the upper hinge 7-1 and the lower hinge 7-2; each spring 8 winds around a corresponding bearing 9; the opening-closing structure 10 is provided between the top part of the front panel 3 and the case body 1; the opening-closing structure 10 is a lock hook structure; a mounting base 12 is provided at a bottom part of the lock hook structure; the mounting base 12 is fixedly connected to the front panel 3; when the opening-closing structure 10 is opened, the front panel 3 is opened; specifically, when the opening-closing structure 10 is opened, the front panel 3 is opened by rotation of the hinge assembly 7 driven by the bearings 9 under action force of the springs 8.

The case body 1 and the front panel 3 of the present utility model are connected through the panel-opening structure 6 configured in between; the panel-opening structure 6 comprises the hinge assembly 7; a pair of bearings 9 and a pair of springs 8 are provided in the hinge assembly 7; the bearings 9 are configured to connect the upper hinge 7-1 and the lower hinge 7-2; when pressing the opening-closing structure 10, the front panel 3 is opened; the bearings 9 drive the hinge assembly 7 to rotate forwards, so that the front panel 3 is opened under the action force of the springs 8. The entire process is fast and convenient, thus greatly improving users' experience when using the luggage case.

The descriptions above are only the preferable embodiments of the present utility model, which are not intended to set a limit to the protection scope of the present utility model; equivalent changes and modifications without departing from the essence of the present utility model shall also fall within the protection scope of the present utility model.

What is claimed is:

1. A luggage case capable of being opened forwards, comprising:

a case body and a pull handle configured on the case body, wherein a front panel is provided on the case body;

a panel fixing frame is provided on a side of the front panel facing towards an inner cavity of the case body;

a snap-fitting structure is provided between the front panel and the panel fixing frame to connect the front panel and the panel fixing frame, wherein the snap-fitting structure comprises a plurality of male buckles and female buckles, wherein the male buckles are provided on the panel fixing frame, and wherein the female buckles are provided on the front panel;

a panel-opening structure is provided at a bottom part of the panel fixing frame, the panel-opening structure comprises a hinge assembly;

a pair of bearings and a pair of springs are provided in the hinge assembly, wherein one end of the hinge assembly is fixed on the panel fixing frame, and another end of the hinge assembly is fixed on the case body; and an opening-closing structure is provided between a top part of the front panel and the case body, when the opening-closing structure is opened, the front panel is opened by rotation of the hinge assembly driven by the pair of bearings under action force of the pair of springs.

2. The luggage case of claim 1, wherein the hinge assembly comprises an upper hinge and a lower hinge, wherein the upper hinge is fixedly connected to the panel fixing frame; the lower hinge is fixedly connected to the case body.

3. The luggage case of claim 2, wherein the upper hinge is provided with a pair of bearing holes, each of the pair of bearings passes through a corresponding bearing hole from the pair of bearing holes, and wherein the lower hinge is provided with fixing grooves; when the pair of bearings pass through the pair of bearing holes, two ends of each of the pair of bearings exposed from the corresponding bearing hole are mounted to a corresponding fixing groove, so as to connect the upper hinge and the lower hinge.

4. The luggage case of claim 1, wherein each of the pair of springs winds around a corresponding bearing from the pair of bearings; the front panel is pushed open by resilient force of the springs when the front panel is allowed to open by opening the opening-closing structure.

5. The luggage case of claim 2, wherein each of the pair of springs winds around a corresponding bearing from the pair of bearings; the front panel is pushed open by resilient force of the springs when the front panel is allowed to open by opening the opening-closing structure.

6. The luggage case of claim 1, when the front panel and the panel fixing frame are connected, the male buckles are snap fitted with the female buckles.

7. The luggage case of claim 1, wherein the opening-closing structure is a lock hook structure; a mounting base is provided at a bottom part of the lock hook structure; the mounting base is fixedly provided on the front panel.

8. The luggage case of claim 7, wherein the lock hook structure comprises a hook hole and a hook; the hook hole is provided on an inner side wall of the case body; the hook is provided on the mounting base.

9. The luggage case of claim 1, wherein an accommodating groove is provided on a side of the case body; a pull handle is provided inside the accommodating groove.

* * * * *